United States Patent [19]

Makiguchi et al.

[11] 4,078,599

[45] Mar. 14, 1978

[54] SELF-CURING AND WATER-SOLUBLE MOLD

[75] Inventors: Toshisada Makiguchi; Akira Muramatsu, both of Tokyo; Hyojiro Kurabe, Fujimi, all of Japan

[73] Assignee: National Research Institute for Metals, Tokyo, Japan

[21] Appl. No.: 769,911

[22] Filed: Feb. 17, 1977

[51] Int. Cl.[2] ..... B22C 1/00

[52] U.S. Cl. ..... 164/41; 164/138; 106/38.2

[58] Field of Search ..... 164/41, 138; 106/38.2

[56] References Cited

U.S. PATENT DOCUMENTS

| | | | |
|---|---|---|---|
| 3,311,488 | 3/1967 | Seufert | 164/41 |
| 3,968,828 | 7/1976 | Toeneskoetter et al. | 164/41 |

*Primary Examiner*—Robert L. Spicer, Jr.

*Attorney, Agent, or Firm*—Wenderoth, Lind & Ponack

[57] ABSTRACT

A process for producing a self-curable and water-soluble mold, which comprises admixing a suitable amount of water with a mixture consisting of (A) 100 parts by weight of refractory sand particles composed of alumina, (B) 1 to 5 parts by weight of at least one alkali metal phosphate selected from the group consisting of potassium phosphate and sodium phosphate, and (C) 0.2 to 3 parts by weight of an aluminum powder; shaping the resulting mixture into a mold of the desired form; and then allowing the mold to cure spontaneously.

4 Claims, No Drawings

SELF-CURING AND WATER-SOLUBLE MOLD

This invention relates to a process for producing a self-curing and water-soluble mold suitable for use in casting aluminum alloys, copper alloys, cast irons and cast steels.

The "self-curing mold" denotes a mold which cures by merely being allowed to stand in the open atmosphere, and curing proceeds by a chemical reaction which takes place during standing.

The "water-soluble mold" denotes a mold which can be easily disintegrated by being immersed in water after casting a molten metal therein, or a mold which can be disintegrated by a slight impact.

Various kinds of molds are used in the casting industry. All of these molds are produced by mixing refractory particles with about 1.5 to 6% of an inorganic or organic binder, and shaping the mixture. The molds are then strengthened, and molten metals are poured thereinto to produce castings. Of these molds, green sand molds gain most widespread acceptance because of their low cost and superior moldability. The "green sand mold" denotes a mold which is produced by adding a small amount of water to a mixture of an aggregate such as silica sand and a binder such as bentonite and shaping the mixture by a mechanical compressive force. The mold strength is obtained by the physical cohering force of bentonite. Since the green sand mold cannot gain sufficient strength by merely being allowed to stand in the open atmosphere after shaping, it is necessary to strengthen it by applying a mechanical force. Employment of such an operation, however, cannot still increase the strength of the green sand mold beyond as low as about 0.3 to 1.5 kg/cm$^2$ in terms of compressive strength, and therefore, the green sand molds are extremely unsatisfactory for production of large castings. Moreover, they have another defect. When, for example, molten case iron is poured into a green sand mold, that part of the mold which has contacted the high temperature molten cast iron, or its vicinity is heated to a temperature of as high as 800° to 1100° C. As a result, the silica sand and bentonite are sintered at the heated part and become vitreous, and the vitrified material coalesces firmly to the resulting casting. It is essential therefore to finish the casting by, for example, shot blasting so as to remove the vitreous substance from it. In this finishing operation, heavy vibration, noises, and dust occur to worsen the working environment.

Accordingly, high-strength molds have been desired in order to eliminate the defect that large castings are difficult to produce by green sand and molds. Recent investigations in an effort to eliminate this defect have resulted in the rapid development of self-curing molds, and various other methods have also been under investigation.

Generally, the "self-curing mold" is a mold which is produced by adding a binder and a small amount of a curing agent to refractory particles as aggregate and shaping the mixture, and which cures by being allowed to stand spontaneously after shaping. Inorganic binders used for producing self-curing molds are roughly divided into the following types:

1. a mixture of sodium silicate as a main binder and a small amount of Fe-Si, Al, Zr, $Al_4C_3$, CaO, $SiO_2$, 2CaO, $SiO_2$, slag, or a phosphoric acid salt as a curing agent;

2. a mixture of acid aluminum phosphate as a main binder with a small amount of an Al powder as a curing agent, and 3. a mixture of a blast furnace slag as a main binder with a small amount of NaOH, KOH or $Ca(OH)_2$ as a curing agent. Self-curing molds containing the sodium silicate-type binder shown in classification (1) above are now most widely used.

These self-curing molds generally have a compressive strength of 1 to 10 kg/cm$^2$ after a lapse of 1 hour and 10 to 30 kg/cm$^2$ after a lapse of 24 hours, and cures to a considerably rigid structure. Since compressive strengths of at least about 20 kg/cm$^2$ are usually considered to be sufficient for molds used to produce large castings, these self-curing molds can be used to produce large casting. However, almost all the conventional self-curing molds are water-insoluble, and therefore, mold releasing, known as "knock-out", after casting must be performed by a mechanical method of applying a heavy impact. This involves heavy vibration, noises and dust which will worsen the working environment and also increase the cost of production.

It is an object of this invention therefore to provide a process for producing a water-soluble self-curing mold which can be easily disintegrated by being immersed in water after pouring to dissolve the binder in water. The process contemplates the water-solubilization of self-curing molds of the conventional types so as to solve the aforesaid problem that arise at the time of knock-out.

Broadly, the present invention provides a process for producing a self-curing and water-soluble mold which comprises admixing a suitable amount of water with a mixture consisting of (A) 100 parts by weight of refractory particles composed of alumina, (B) 1 to 5 parts by weight of at least one alkali metal phosphate selected from the group consisting of potassium phosphate and sodium phosphate, and (C) 0.2 to 3 parts by weight of an aluminum powder; shaping the resulting mixture into a mold of the desired form; and then allowing the mold to cure spontaneously.

The term "mold", as used in the present specification and the appended claims, is meant to include both a mold for producing cavity-free casting, and a core for producing cavity-containing castings.

The important requirement of the process of this invention is to use alumina refractory particles as an aggregate (component A), potassium phosphate and/or sodium phosphate as a binder (component B), and an aluminum powder as a curing agent (component C). It is believed that in the process of this invention, an exothermic reaction between the aluminum powder and the phosphate gives aluminum phosphate, and as a result, a curing reaction proceeds.

The use of alumina as an aggregate is of utmost importance in the process of this invention in order to disintegrate the mold easily by only immersing it in water after a molten metal has been poured therein and a casting produced from it. Use of silica now in common acceptance, instead of the alumina, would lead to the loss of the water-solubility of the mold after pouring because of its contact with molten metal at high temperatures (for example, a copper alloy will be heated to about 950° C, and a cast iron, to about 1100° C) although before pouring the mold is water-soluble. In contrast, the mold containing alumina as an aggregate in accordance with this invention retains its water-solubility even after it has been subjected to heat by pouring.

Thus, it is possible to achieve the object of the present invention of releasing the mold from castings by merely immersing it in water without requiring such a mechanical method which will generate vibration, noises and dust. Preferably, the operation of immersing the mold in water for knock-out is carried out after the casting has been allowed to cool to a certain temperature, because the quality of the casting would be debased if the mold is immersed in water while the casting is still at too high temperatures. It is not necessary however to cool the casting to room temperature, but cooling of it to a temperature which does not deteriorate the quality of the casting during water immersion suffices. For example, in the case of cast iron, it is sufficient to cool the mold to about 700° C.

The particle size of the alumina particles used as componet (A) is not critical in particular, and alumina particles having sizes usually used in the casting industry, for example, about 75 to 150 mesh, can be conveniently used. Aluminum used as component (C) must be powdery in order to ensure good reactivity, and its suitable particle size is smaller than 200 mesh. The amount of water to be added to the mixture of components (A), (B) and (C) is not critical in particular, and its suitable amount is usually 1 to 10 parts by weight per 100 parts by weight of component (A). The mixture obtained by mixing water is shaped into a mold by any known method, and then cured by being allowed to stand in the open stmosphere.

The strength of the mold obtained by the process described above generally depends upon the amounts of components (B) and (C), and tends to be higher the larger the amounts of components (B) and (C). It is possible therefore to produce castings having a compressive strength of more than 20 kg/cm$^2$ if the amounts of components (B) and (C) are large. When the amounts of components (B) and (C) are small, the resulting mold may not have sufficient strength for production of large castings, but can be satisfactorily used if so much strength is not required.

According to preferred embodiments of the present invention, there is provided a process for producing a self-curing and water-soluble mold, which comprises preparing a mixture consisting of the specified amounts of components (A), (B) and (C) and in addition, the following components (D) and/or (E), adding a suitable amount of water to the mixture, shaping the mixture into a mold of the desired shape, and then allowing the mold to cure spontaneously.

Component (D)

1 to 5 parts by weight of at least one alkali metal aluminate selected from the group consisting of potassium aluminate and sodium aluminate Component (E)

1 to 5 parts by weight of at least one alkali metal carbonate selected from the group consisting of potassium carbonate and sodium carbonate The aluminate as an optical component (D) is considered to induce an exothermic reaction with the aluminum powder thus giving alumina gel which will promote the curing reaction. Generally, the use of aluminate salts tends to increase the strength of the resulting mold considerably.

The carbonate as an optional component (E) also tends to contribute to an increase in the strength of molds although not to such a degree as is achieved by the aluminates. The most important effect obtained by the addition of component (E) is to reduce the humidification of the mold. Molds obtained by those embodiments of the invention which do not use component (E), i.e., the method using components (A), (B) and (C) and the method using components (A), (B), (C) and (D), have some hygroscopicity, and upon standing in the open atmosphere for a long time of, say, several days, may soften at their surfaces and decrease in mold strength.

This sometimes becomes a trouble when pouring of a metal into the mold is not done immediately after shaping but after several days from the shaping of the mold. The use of component (E) is beneficial for avoiding this trouble.

While the present invention primarily contemplates the spontaneous curing of molds after shaping, it is possible to heat the surface of the molds locally in order to promote the curing reaction. Particularly, when the mold is of small size, the heat dissipating area of the mold per unit volume increases, and the exothermic reaction mentioned hereinabove tends to fail. This retards the rate of curing reaction. In such a case, it is advantageous to employ the above-mentioned method of local heating.

The water-soluble self-curing molds in accordance with this invention is especially suitable for production of castings of aluminum alloys, copper alloys, cast irons and cast steels. In spite of the fact that the molds of the invention are self-curing, they are water-soluble and easily disintegrable in water both after curing and after pouring of molten metals. Knock-out of the molds in the production of castings, therefore, becomes easy, and a technical advantage can be obtained in the casting process. Moreover, since a knock-out operation becomes easy, a reduction in the cost of production can be expected, and the working environment can be markedly improved.

The following examples illustrate the present invention more specifically.

EXAMPLE 1

100 Parts by weight of alumina particles having a particle diameter of 75 to 150 mesh as refractory particles (component A) was mixed with the components shown in Table 1 in the amounts indicated. Three parts by weight of water was mixed with each of the resulting mixtures, and from each of the resulting mixtures, cylindrical test samples having a diameter of 50 cm and a height of 50 cm were prepared. In order to promote curing, one end surface of each of the cylindrical test samples was placed for 5 minutes on an iron plate heated at 130° C. Then, the samples were each turned upside down, and the other end surface was placed on the iron plate for 5 minutes. The test samples were then removed from the iron plate, and allowed to stand in the open atmosphere. The curing reaction continued during this time, but ended within one hour after standing. The test samples which had been allowed to stand for one hour were tested for compressive strength and water solubility.

Furthermore, in order to simulate heating of molds by the pouring of molten metals, the test samples which had been left to stand for 1 hour were placed in ovens held at a temperature of 950° C and 1100° C respectively. After the central portion of each sample reached the heating temperature, the samples were placed therein for an additional 10 hours. Then, the samples were withdrawn from the ovens, cooled to room temperature, and tested for water-solubility.

The results of experiments are shown in Table 1.

The results shown in Table 1 show that when alumina was used as the aggregate, both the unheated cured samples and the heated cured samples showed good water solubility, but that when silica was used as the aggregate, the heated cured samples had markedly reduced water solubility although the unheated cured samples showed good water solubility.

Runs Nos. 11 and 12 in Table 1 were comparative experiments in which the aluminum powder as component (C) was not used. It can be seen that in this case, the strengths of the molds were too low to be feasible.

Table 1

| Run No. | Amounts in parts by weight of components: B $K_3PO_4$ | C Al powder (375 mesh) | D $K_2Al_2O_4$ | E $K_2CO_3$ | Aggregate (*) | Compressive strength (kg/cm²) | Water solubility: 1 hour after curing | heated at 950° C | heated at 1100° C |
|---|---|---|---|---|---|---|---|---|---|
| 1 | 1 | 0.2 | — | — | A | 3 | ◎ | ◎ | ○ |
| | | | | | S | 2 | ◎ | X | X |
| 2 | 2 | 0.5 | — | — | A | 12 | ◎ | ◎ | ○ |
| | | | | | S | 9 | ◎ | X | X |
| 3 | 3 | 1.5 | — | — | A | 21 | ◎ | ◎ | ◎ |
| | | | | | S | 18 | ◎ | X | X |
| 4 | 1 | 0.5 | 1 | — | A | 8 | ◎ | ◎ | ○ |
| | | | | | S | 5 | ◎ | X | X |
| 5 | 2 | 0.5 | 2 | — | A | 16 | ◎ | ◎ | ○ |
| | | | | | S | 13 | ◎ | X | X |
| 6 | 1 | 0.2 | — | 1 | A | 5 | ◎ | ◎ | ○ |
| | | | | | S | 3 | ◎ | X | X |
| 7 | 1 | 0.5 | 2 | 1 | A | 9 | ◎ | ◎ | ○ |
| | | | | | S | 7 | ◎ | X | X |
| 8 | 3 | 1.5 | 2 | 3 | A | 23 | ◎ | ◎ | ◎ |
| | | | | | S | 20 | ◎ | X | X |
| 9 | 4 | 2 | 3 | 4 | A | 28 | ◎ | ◎ | ◎ |
| | | | | | S | 24 | ◎ | X | X |
| 10 | 5 | 3 | 5 | 3 | A | 31 | ◎ | ◎ | ◎ |
| | | | | | S | 27 | ◎ | ○ | X |
| 11 | 0.5 | — | — | — | A | 0.6 | ◎ | ◎ | ○ |
| 12 | 3 | — | — | — | A | 0.8 | ◎ | ◎ | ◎ |

(*) A refers to the case of using alumina, and S, to the case of using silica.

EXAMPLE 2

In Example 1, potassium salts were used as the phosphate (Compnent B), aluminate (component D) and carbonate (component E). In Example 2, sodium salts, and a mixture of sodium and potassium salts were used as these components as shown in Table 2, and otherwise, the conditions employed were the same as set forth in Example 1.

The results of experiments are shown in Table 2. It can be seen that in Example 2, substantially the same results as in Example 1 were obtained.

EXAMPLE 3

In accordance with the recipe shown in Run No. 5 in Example 1 in Table 1, a mold for a differential gear case of an automobile having a weight of about 2 kg was produced, and cured by allowing it to stand in the open atmosphere. The curing was completed in about one hour. After pouring a molten cast iron into this mold, it was allowed to stand in the open atmosphere for 1 hour to cool it to a temperature of about 700° C. When it was gradually immersed in water, the mold disintegrated easily, and a complete casting free from any mold adhering thereto was obtained.

We claim:

1. A process for producing a self-curable and water-soluble mold, which comprises admixing a suitable amount of water with a mixture consisting of (A) 100 parts by weight of refractory sand particles composed of alumina, (B) 1 to 5 parts by weight of at least one alkali metal phosphate selected from the group consisting of potassium phosphate and sodium phosphate, and (C) 0.2 to 3 parts by weight of an aluminum powder; shaping the resulting mixture into a mold of the desired form; and then allowing the mold to cure spontaneously.

2. The process of claim 1 wherein the mixture further contains (D) 1 to 5 parts by weight of at least one alkali metal aluminate selected from the group consisting of potassium aluminate and sodium aluminate.

Table 2

| Run No. | Amounts in parts by weight of components: B $K_3PO_4$ | B $Na_3PO_4$ | C Al powder | D $Na_2Al_2O_4$ | E $Na_2CO_3$ | Aggregate | Compressive strength (kg/cm²) | Water solubility: 1 hour after curing | heated at 950° C | heated at 1100° C |
|---|---|---|---|---|---|---|---|---|---|---|
| 1 | — | 2 | 0.5 | — | — | A | 10 | ◎ | ◎ | ○ |
| | | | | | | S | 8 | ◎ | X | X |
| 2 | — | 2 | 0.5 | 2 | — | A | 13 | ◎ | ◎ | ○ |
| | | | | | | S | 11 | ◎ | X | X |
| 3 | — | 1 | 0.2 | — | 1 | A | 3.5 | ◎ | ◎ | ○ |
| | | | | | | S | 2.5 | ◎ | X | X |
| 4 | — | 4 | 2 | 3 | 4 | A | 26 | ◎ | ◎ | ◎ |
| | | | | | | S | 20 | ◎ | ○ | X |
| 5 | 3 | — | 1.5 | 2 | 3 | A | 17 | ◎ | ◎ | ◎ |
| | | | | | | S | 15 | ◎ | X | X |
| 6 | — | 4 | 2 | 4 | 3 | A | 25 | ◎ | ◎ | ◎ |
| | | | | | | S | 21 | ◎ | ○ | X |

3. The process of claim 1 wherein the mixture further contains (E) 1 to 5 parts by weight of at least one alkali metal carbonate selected from the group consisting of potassium carbonate and sodium carbonate.

4. The process of claim 1 wherein the mixture further contains (D) 1 to 5 parts by weight of at least one alkali metal aluminate selected from the group consisting of potassium aluminate and sodium aluminate, and (E) 1 to 5 parts by weight of at least one alkali metal carbonate selected from the group consisting of potassium carbonate and sodium carbonate.

* * * * *

UNITED STATES PATENT AND TRADEMARK OFFICE

CERTIFICATE OF CORRECTION

PATENT NO. : 4,078,599

DATED : March 14, 1978

INVENTOR(S) : Toshisada Makiguchi, Akira Muramatsu and Hyojiro Kurabe

It is certified that error appears in the above-identified patent and that said Letters Patent are hereby corrected as shown below:

In the heading of the Patent, in the space provided for priority information, insert the following:

--[30] Foreign Application Priority Data

July 26, 1976 Japan ..... 51-88207

Signed and Sealed this

*Twenty-ninth* Day of *January 1980*

[SEAL]

*Attest:*

SIDNEY A. DIAMOND

*Attesting Officer*

*Commissioner of Patents and Trademarks*